US006460726B1

(12) United States Patent
Hierzer et al.

(10) Patent No.: US 6,460,726 B1
(45) **Date of Patent: *Oct. 8, 2002**

(54) CLOSURE WITH ARTICULATED LID

(75) Inventors: Valentin Hierzer, Arlington Heights; Brian Hessel, Rolling Meadows; Eugene Dorsch, Long Grove, all of IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/718,817

(22) Filed: Nov. 22, 2000

Related U.S. Application Data

(63) Continuation of application No. 09/093,290, filed on Jun. 8, 1998, now Pat. No. 6,152,320.

(51) Int. Cl.[7] ..... B65D 39/00; B65D 47/08

(52) U.S. Cl. ..... 220/838; 215/235; 215/237; 222/498; 222/556

(58) Field of Search ..... 215/235, 252, 215/254, 232, 237; 220/335, 834, 837–839, 259.2, 254.6; 222/498, 556

(56) References Cited

U.S. PATENT DOCUMENTS

| | | | | |
|---|---|---|---|---|
| 3,160,327 A | | 12/1964 | Porcelli | |
| 3,845,872 A | | 11/1974 | Towns et al. | |
| 4,257,537 A | | 3/1981 | Uhlig | |
| 4,269,330 A | | 5/1981 | Johnson | |
| 4,356,935 A | | 11/1982 | Kamin | |
| 4,358,032 A | | 11/1982 | Libit | |
| 4,414,705 A | | 11/1983 | Ostrowsky | |
| 4,503,991 A | | 3/1985 | Joyce | |
| 4,533,058 A | | 8/1985 | Uhlig | |
| 4,634,011 A | | 1/1987 | Polyblank | |
| 4,638,916 A | | 1/1987 | Beck et al. | |
| 4,699,283 A | | 10/1987 | Dubach | |
| 4,713,219 A | | 12/1987 | Gerkin et al. | |
| 4,801,054 A | | 1/1989 | Nycz | |
| 4,948,003 A | | 8/1990 | Munoz | |
| 5,016,777 A | | 5/1991 | Marvin | |
| 5,147,054 A | | 9/1992 | Pehr | |
| 5,221,017 A | | 6/1993 | Cistone et al. | |
| 5,257,708 A | | 11/1993 | Dubach | |
| 5,314,085 A | | 5/1994 | Collado Bonet | |
| 5,322,176 A | | 6/1994 | Dubach | |
| 5,368,176 A | | 11/1994 | Thanisch | |
| 5,372,268 A | | 12/1994 | Han | |
| 5,392,938 A | | 2/1995 | Dubach | |
| 5,400,912 A | * | 3/1995 | Brown et al. | 220/838 |
| 5,501,348 A | | 3/1996 | Takeuchi | |
| 5,558,239 A | | 9/1996 | Dubach | |
| 5,588,562 A | | 12/1996 | Sander et al. | |
| 5,769,253 A | | 6/1998 | Gross | |
| 5,938,087 A | | 8/1999 | Randall | |
| 6,003,712 A | * | 12/1999 | Mogard et al. | 220/257 |
| 6,216,905 B1 | * | 4/2001 | Mogard et al. | 220/257 |

FOREIGN PATENT DOCUMENTS

| | | |
|---|---|---|
| EP | 0 447 357 A2 A3 | 9/1991 |
| GB | 2 224 309 | 5/1990 |
| JP | 7-330009 | 12/1995 |

OTHER PUBLICATIONS

Two color photographs of Wei–Chuang "Daily C Juice" bottle (date unknown).

* cited by examiner

*Primary Examiner*—Stephen P. Garbe
*Assistant Examiner*—Joseph C. Merek
(74) *Attorney, Agent, or Firm*—Woodcock Washburn LLP

(57) ABSTRACT

A flip-top type closure resealably seals a fluid container. The closure includes a body portion, which is attachable to the fluid container, and a cap portion. The cap portion is connected to the body portion by two hinges and is rotatable about the two hinges so that a spout of the body portion may be inserted into the mouth without interference by the cap portion. The closure may include a tamper-evident band to visually indicate tampering with the contents of the fluid container. The closure may also include a pull-tab seal secured to the spout to prevent spillage and/or leakage of the contents of the fluid container.

27 Claims, 4 Drawing Sheets

CLOSURE WITH ARTICULATED LID

This Application is a continuation of U.S. application Serial No. 09/093,290 filed Jun. 8, 1998 now U.S. Pat. No. 6,152,320.

BACKGROUND OF THE INVENTION

1. Field of the Invention

This invention relates generally to a closure for a fluid container and, more particularly, to a resealable closure for a fluid container that permits a person to drink from the container without removing the closure from the container and without interference from the closure.

2. Description of the Related Art

Several types of closures for resealably closing a fluid container are known in the art. A removable cap may be provided on the fluid container, the removal of which requires the cap to be detached by, for example, an unscrewing action, from the container. This type of cap may be easily misplaced or lost. Further, this type of cap generally requires the use of two hands for removal, thereby limiting its usefulness. For example, persons engaged in exercise, operating a vehicle or riding a bicycle should not use this type of closure. As the screw-type cap generally requires several turns to remove the cap from the container, the act of opening and closing the container may become an inconvenience and a distraction to those desiring to repeatedly open and close the container in a short period of time.

Another type of closure includes a movable cylindrical member having a central orifice, which is resealably sealed by a stationary stem. This type of closure need not be removed from the container in order to gain access to the fluid. When this type of closure is in a closed position, the cylindrical member is pushed downwardly so that the stem substantially plugs the orifice, preventing the flow of fluid from the fluid container therethrough. When this type of closure is in an open position, the cylindrical member is pulled upwardly so that the stem is positioned away from the orifice, thereby allowing fluid to flow from the fluid container therethrough. This type of closure permits the cylindrical portion to enter the mouth of a person to minimize or eliminate spilling the fluid. This type of closure, however, generally requires the use of two hands to open or close the closure, which may be disadvantageous to, for example, a person exercising, operating a vehicle or riding a bicycle as discussed in the above.

Another type of closure is one that includes a flip-type lid or cap, which is rotated about a hinge to expose an aperture, through which the fluid may flow when the closure is in an open position. This type of closure does not include a spout that may be inserted into the mouth. Thus, to eliminate spillage, the fluid must be ejected through the aperture under pressure by, for example, squeezing the fluid container, to direct a stream of the fluid into the mouth. This squeezing action may cause fatigue or other undesirable stresses on the container. Additionally, the effectiveness of the squeezing action may be reduced as the level of fluid in the container decreases. Further, the hinge of the flip-type lid permits only limited rotation of the lid. Thus, a person attempting to drink the fluid will experience interference with the lid if the closure is brought too close to the face, thereby hindering the drinking process.

U.S. Pat. No. 3,160,327 to Porcelli describes a dispensing spout having a diaphragm for sealing the same and a captive cap for reusably closing the spout. The diaphragm is integrally molded with the dispensing spout, and a single flexible hinge connects the cap to the spout.

U.S. Pat. No. 4,269,330 to Johnson describes a cartridge-type sauce extruder. The extruder includes an extrusion orifice at one end and is open at the other end to receive a movable bottom plug. The orifice is sealed with a disc that is pre-scored or pre-cut to form a multi-segmented nozzle. At the time of filling, the orifice is closed with a piece of impervious film-like material to form a seal to protect the orifice from contact with any contaminants.

U.S. Pat. No. 4,356,935 to Kamin describes a method and apparatus for storing and dispensing fluid foodstuff. The container includes a spiral wound tube having a circular retaining disc mounted at one end. The disc has an aperture, through which is mounted a pressure-responsive dispensing nozzle. A sheet of metallic material is attached to the dispensing nozzle to provide a temporary seal.

U.S. Pat. No. 4,801,054 to Nycz describes a watertight molded plastic dispensing closure for attachment to the finish of a container. A body portion is connected to the finish, and a cover portion is hingedly attached to the body portion and is foldable with respect thereto.

U.S. Pat. No. 5,372,268 to Han describes a pull-tab inner seal for sealing a container. The inner seal includes three layers, namely, a sealing material layer for bonding the inner seal to a container, a layer substantially impermeable to air and moisture, and a reinforcing layer. The reinforcing layer includes at least two plies of monoaxially oriented film combined in lamination with the strong direction of at least one ply crossing the weak direction of another ply.

SUMMARY OF THE INVENTION

Therefore, in order to overcome these and other problems, it is an object of the present invention to provide a releasable closure for a fluid container that permits a person to drink from the container without removing the closure from the container.

It is a further object of the present invention to provide a resealable closure for a fluid container that may be opened and closed with only one hand.

It is still a further object of the present invention to provide a resealable closure having a flip-type lid or cap for a fluid container that may be at least partially inserted into the mouth to minimize or eliminate spillage without-interference by the flip-type cap.

The above and other beneficial objects of the present invention are attained in accordance with the present invention by providing a closure for a fluid container that has a flip-type cap connected to a body by two hinges. The two hinges permit the cap to be rotated away from the body approximately 180-degrees between an opened position and a closed position. The closure further includes a spout portion that may be inserted into the mouth. The closure may include a tamper-evident band for visually indicating tampering with the closure, the fluid container or the contents thereof. The closure may further include a removable seal to further visually indicate tampering with the closure, the fluid container or the contents thereof and to prevent contamination and leakage of the contents from the fluid container.

BRIEF DESCRIPTION OF THE DRAWINGS

Embodiments of the present invention will be described with reference to the accompanying drawings in which.

DETAILED DESCRIPTION OF THE PREFERRED EMBODIMENTS

Figure 1:
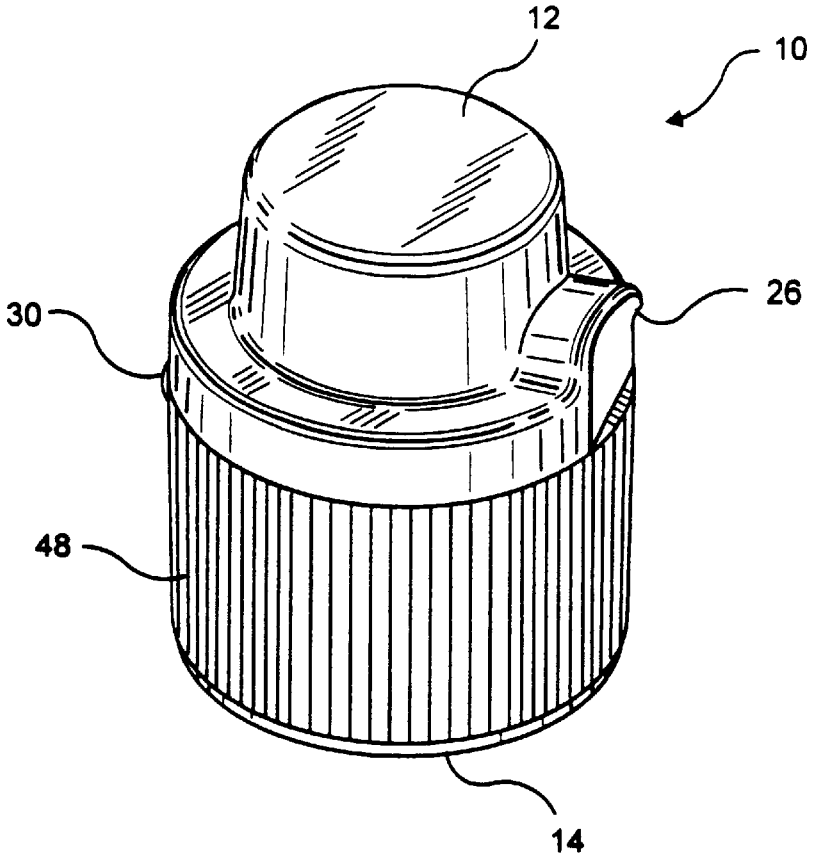
FIG. 1 is a front perspective view of a first embodiment of such closure in a closed position.

Those skilled in the art will gain an understanding of the invention from a reading of the following description of the preferred embodiments when read in conjunction with a viewing of the accompanying drawings of FIGS. 1–8, inclusive. The individual reference numerals designate the same or similar elements throughout the several drawings.

Figure 2:
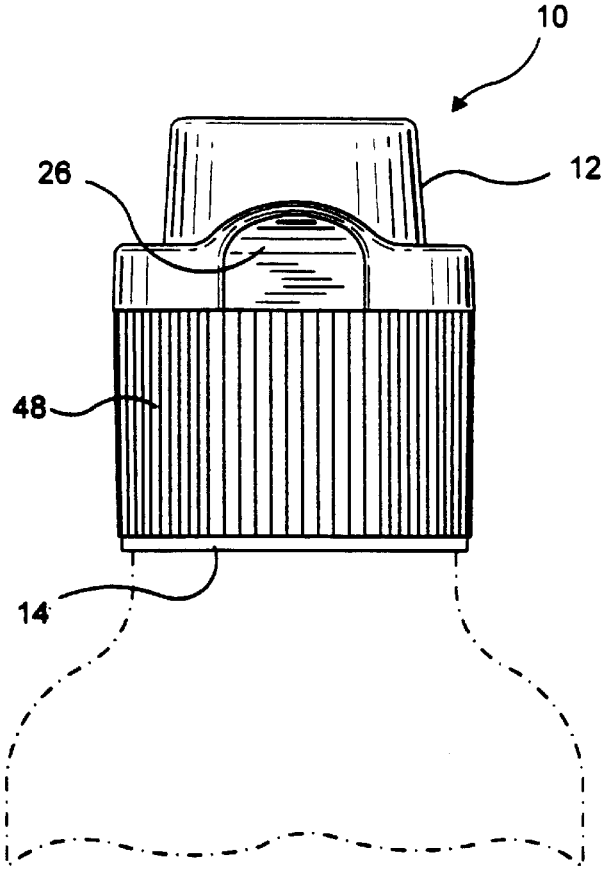
FIG. 2 is a front elevational view of the first embodiment of the closure in the closed position.
Figure 3:
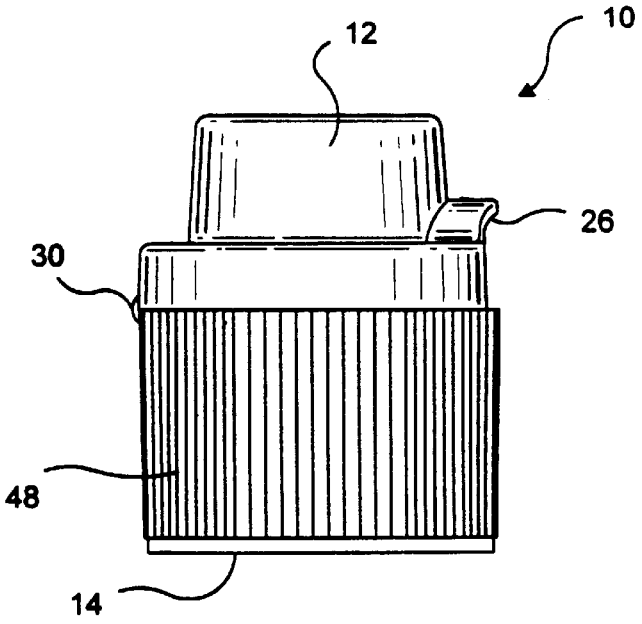
FIG. 3 is a side elevational view of the first embodiment of the closure in the closed position.

Referring to FIG. 1, there is seen a front perspective view of a closure 10 having a body 14 and a cap or lid 12. As illustrated in FIG. 1, closure 10 is in a closed position. Body 14 and cap 12 are joined by hinge 30, thereby forming a one-piece, or integral, closure 10. Body 14 may include striations 48 to facilitate installation of closure 10 onto, for example, a bottle or other container, shown in phantom in FIG. 2, and removal therefrom. FIGS. 2 and 3 are respectively front and side elevational views of the closure 10, also in the closed position.

Figure 4:
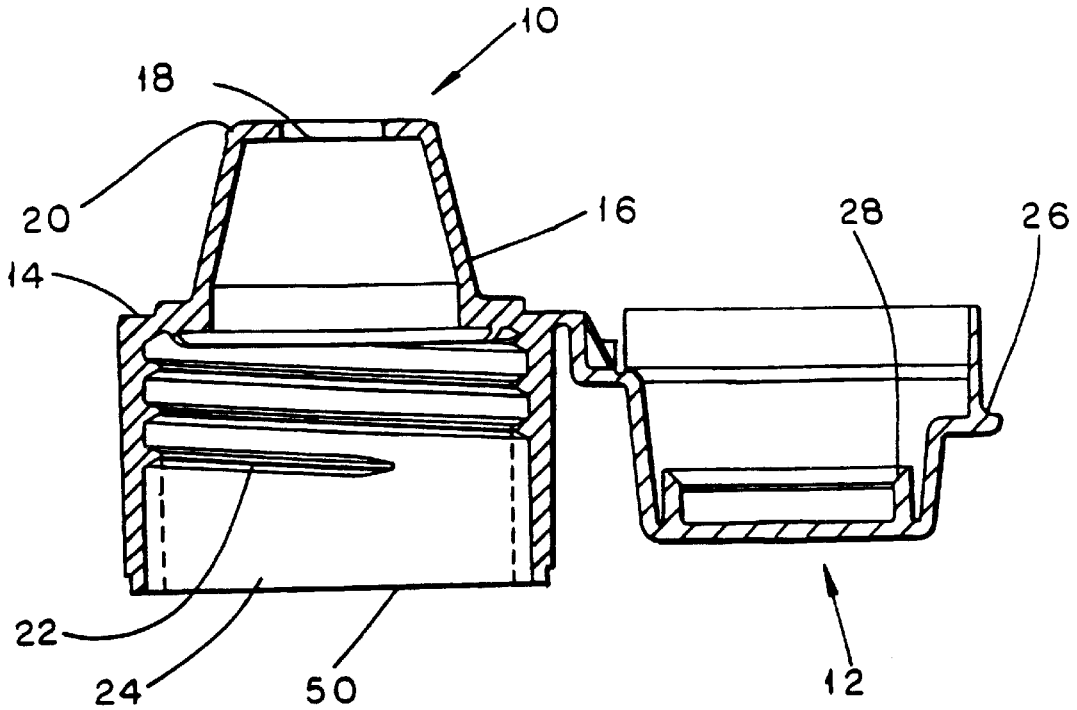
FIG. 4 is a side sectional view of the first embodiment of the closure in an open position.

Referring now to FIG. 4, there is seen a side sectional view of the closure 10 in an open position. Body 14 is comprised of a shank portion 24 and a spout portion 16. Body 14 includes a central orifice 50 extending from shank portion 24 to an aperture 18 in spout portion 16. Aperture 18 permits expulsion or discharge of a fluid, such as water or other beverages, from the bottle or other container, onto which closure 10 is attached. It will be appreciated that aperture 18 is completely open and that a flow of a fluid therethrough is not impeded by any sealing mechanisms or structures such as that known in the prior art. Orifice 50 includes internal threads 22 for mating with external threads of, for example, the bottle or other container. Spout portion 16 is in the form of a conical frustum. Located at the top of spout portion 16 is an external annular lip 20 extending generally perpendicular to the central axis of spout 16. Lip 20 is adapted by size and configuration to mate with cylindrical receiving collar 28 of cap 12. Collar 28 of cap 12 is in the form of an annulus having a triangulated upper surface. When closure 10 is in the closed position, the top portion of spout portion 16 is inserted into collar 28, annular lip 20 being in abutment with the inside wall of collar 28. This friction fit between annular lip 20 and collar 28 provides a fluid-tight seal, thereby preventing spillage or leakage of the fluid through aperture 18.

Spout portion 16 is of an appropriate size and configuration to permit at least partial insertion into the mouth of a person. As illustrated in FIG. 4, when closure 10 is in the open position, spout portion 16 extends above the height of the height of cap 12 so that cap 12 does not interfere with the insertion of spout portion 16 into the mouth. Thus, the cap 12 does not impede drinking of the fluid contained in the fluid container. Further, the dual hinge, more fully described hereinafter, connecting cap 12 to body 14 permits cap 12 to be rotated away from any obstruction to further facilitate drinking from the fluid container.

Figure 6:
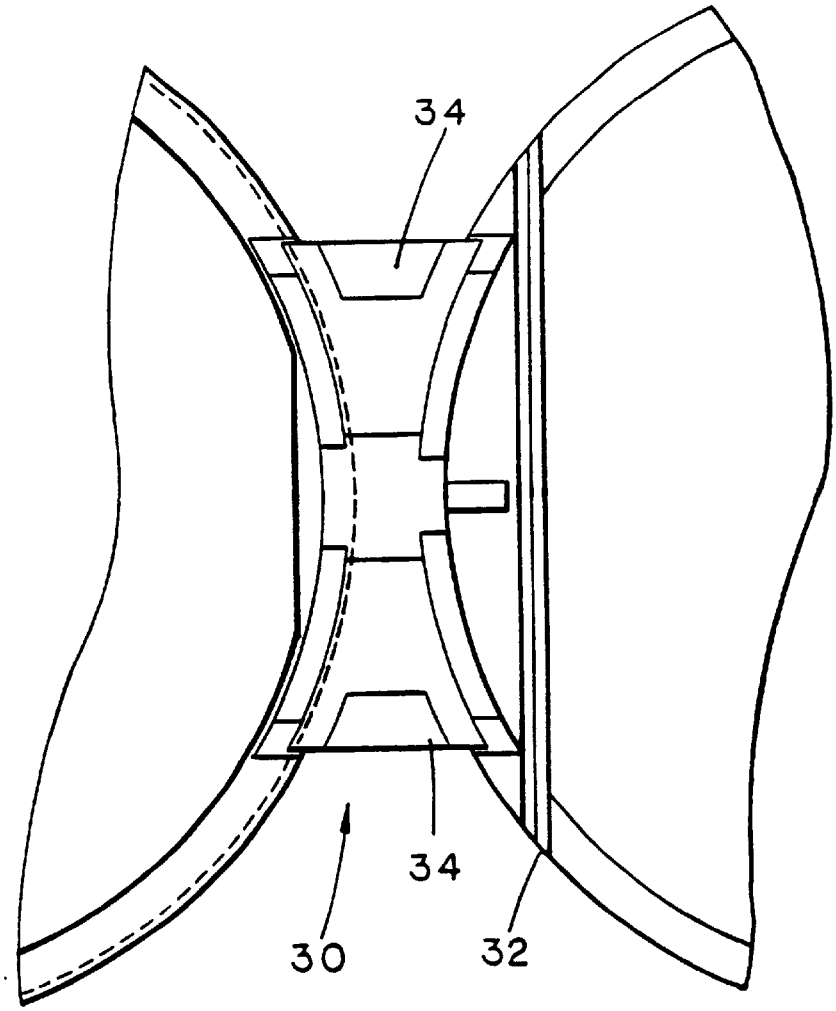
FIG. 6 is a top plan view of the hinge of the first embodiment of the closure.
Figure 5:
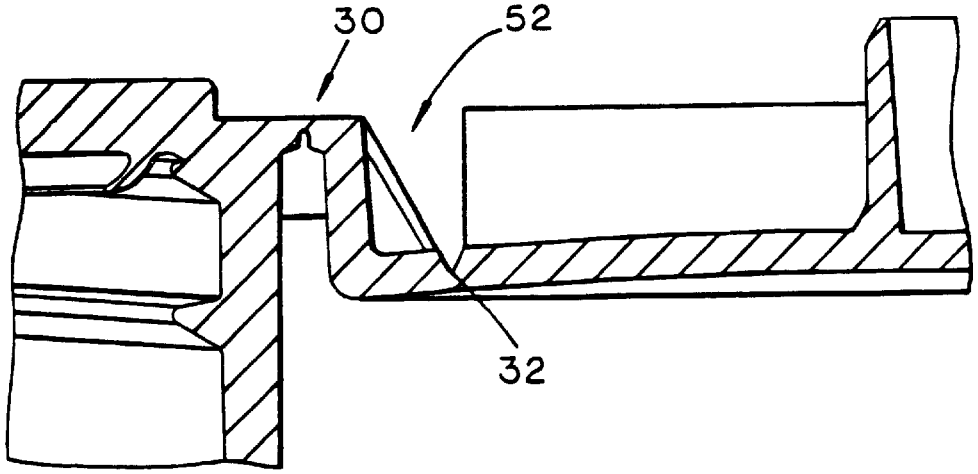
FIG. 5 is a side sectional view of a hinge of the first embodiment of the closure.

Referring now to FIGS. 5 and 6, it can be seen that body 14 and cap 12 are connected by hinge 30. Hinge 30 includes a pair of flexible web members 34 that extend outwardly from the center of hinge 30, downwardly from the top of shank portion 24 and upwardly from the bottom of cap 12. Accordingly, web members 34 have a generally triangular shape. Hinge 30 permits cap 12 to be pivoted both toward and away from body 14 about an axis generally centrally located on hinge 30 between body 14 and cap 12. This axis is generally tangential to body 14 and cap 12. Thus, cap 12 forms a resealable closure. Hinge 30 is of a type generally referred to in the art as a snap hinge. Cap 12 also includes a detent 52 extending from the bottom of cap 12 toward the top of cap 12, thereby forming a flexible portion 32 in the top of cap 12. Flexible portion 32 defines a second hinge, of a type generally referred to in the art as a living hinge. Accordingly closure 10 defines a dual-hinge closure. The combination of hinge 30 and flexible portion 32 permits cap 12 to be rotated from a closed position where cap 12 covers spout portion 16 to an open position where spout portion 16 is exposed. Cap 12 rotates to such an extent to facilitate drinking from spout portion 16 without interference from cap 12. That is, when cap 12 is in its open position, cap 12 is preferably rotated about the axis of hinge 30 and is further rotated due to the flexibility of flexible portion 32 so that cap 12 can be rotated a total of at least 180-degrees from its closed position. It will be appreciated that the flexibility of hinge 30 and flexible portion 32 permit cap 12 to be further rotated even when cap 12 is in its fully opened position. Thus, if a person drinking a fluid from the container experiences interference by cap 12, cap 12 will be forced into a further extended position to prevent interference with access to spout portion 16.

Cap 12 further includes a tab 26 extending radially outwardly to facilitate opening closure 10. Body 14 may include a recess, not shown, that corresponds to tab 26 to further facilitate opening closure 10. Tab 26 permits the position of cap 12 to be changed from the closed position to the open position with one hand. More particularly, tab 26 permits opening of closure 10 with the simple action of the thumb while holding the container, not shown, with the other four fingers. Similarly, cap 12 may be rotated from the open position to the closed position with one hand, and, in particular, by the action of the thumb while the container, not shown, is held in the hand by the other four fingers.

Figure 7:
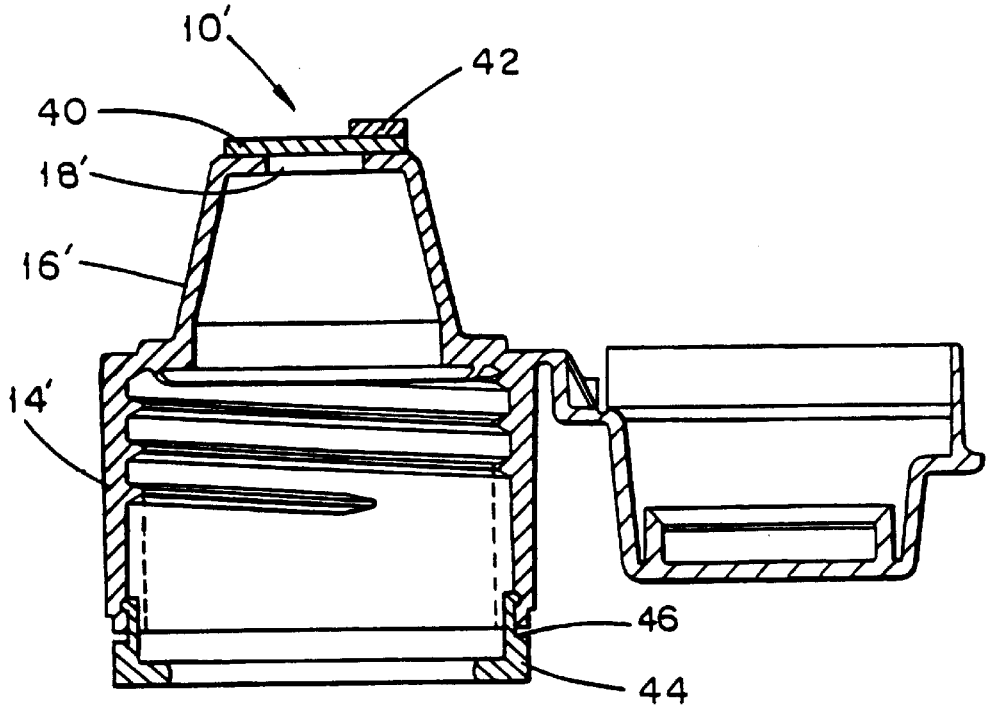
FIG. 7 is a side sectional view of a second embodiment of the closure in an open position.

Referring now to FIG. 7, there is seen a side sectional view of a second embodiment of closure 10' in an open position. Like parts are noted by an accompanying prime. Closure 10' includes a tamper-evident band 44 connected to body 14' by a series of frangible portions 46. If closure 10' is at least partially removed from the container, to which it is attached, frangible portions 46 will fracture, causing tamper-evident band 44 to separate from body 14'. Thus, tamper evident band 44 provides a visual indication of tampering with closure 10', the container or the fluid or other material contained therein. Closure 10' further includes a pull-tab liner 40, which seals the aperture 18'. Pull-tab liner 40 may be attached to the spout portion 16' by, for example, induction heat-sealing. A pull-tab 42 is provided on the pull-tab liner 40 to facilitate the removal of pull-tab liner 40 from spout portion 16' by a simple lifting and pulling action. Pull-tab liner 40 provides further visual indication of tampering with closure 10', the container or the fluid or other material container therein. Pull-tab liner 40 further eliminates contamination of the contents of the fluid container and leakage or spillage thereof.

Figure 8:
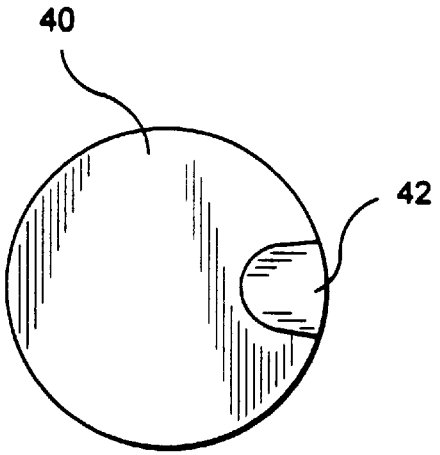
FIG. 8 is a top plan view of a pull-tab liner of the second embodiment of the closure illustrated in FIG. 7.

Referring now to FIG. 8, there is seen a top plan view of pull-tab line 40 illustrated in FIG. 7.

It will be appreciated that closure 10, 10' may be formed of any suitable resin material. Preferably, closure 10, 10' is formed of a resilient material, such as polypropylene. It will be further appreciated that closure 10, 10' may be formed by such processes as injection molding.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A closure for resealably sealing a fluid container, said closure comprising:

a body portion including a spout portion and a downwardly depending shank, said spout portion including an aperture for permitting a fluid contained is said fluid container to flow therethrough, said shank including an attachment feature protruding generally inwardly, a cap portion for resealably sealing said aperture; and a first hinge and a second hinge for permitting said cap portion to be articulated with respect to said body portion between an open position and a closed position, the first hinge defining a first axis of rotation of the cap portion of the cap portion relative to the body portion, said first hinge comprising a flexible web including a first end directly coupled to the shank and an opposing second end directly, coupled to the cap portion, the second hinge defining a second axis of rotation of the cap portion relative to the body portion;

wherein the spout portion protrudes substantially upwardly relative to the first hinge and the second hinge while the cap is in the closed position.

2. The closure according to claim 1, wherein said second hinge comprises a detent that forms a flexible member on said cap connecting said cap portion to said flexible web.

3. The closure of claim 2, wherein said cap is rotatable with respect to said body portion about said first hinge and said second hinge in excess of approximately 180-degrees between said open position and said closed position.

4. The closure according to claim 2, wherein said body, portion cap portion, said first hinge and said second hinge are integrally formed.

5. The closure according to claim 1, further comprising means for visually indicating at least partial removal of said body portion from said container.

6. The closure according to claim 5, wherein said visually indicating means comprises a tamper evident band being frangible connected to said body portion, said tamper evident band at least partially separating from said body portion when said body portion is at least partially removed from said container.

7. The closure according to claim 1, further comprising means for sealing said aperture.

8. The closure according to claim 7, in wherein said sealing means comprises a sheet of material secured to said spout portion and covering said aperture.

9. The closure according to claim 8, wherein said sheet is secured to said spout portion by induction heat sealing.

10. The closure according to claim 8, wherein said sealing means includes means for removing said sheet from said spout portion.

11. The closure according to claim 10, wherein said removing means comprises a pull-tab.

12. The closure according to claim 1, further comprising a tab extending radially outwardly from said cap portion.

13. The closure according to claim 12, wherein said tab is located on said cap opposite to said first hinge and said second hinge.

14. The closure according to claim 1, wherein said spout portion includes an annular lip extending radially outwardly from a top of said spout portion and wherein said cap includes a collar for receiving said top of said spout portion when said cap is in said closed position.

15. The closure according to claim 14, wherein said annular lip frictionally engages said collar when said cap is in said closed position.

16. The closure according to claim 1, wherein said attachment feature comprises internal threads in said body portion.

17. The closure according to claim 1, wherein said spout portion is in the form of a conical frustum.

18. The closure according to claim 1, wherein said spout portion is at least partially insertable into a person's mouth.

19. The closure according to claim 1, wherein said cap is movable from said open position to said closed position by using one hand.

20. The closure according to claim 1, wherein said cap is movable from said closed position to said open position by using one hand.

21. The closure according to claim 1, wherein said first hinge includes a snap hinge.

22. The closure according to claim 1, wherein said second hinge includes a living hinge.

23. The closure of claim 1 wherein the shank forms a curved shape in transverse cross section, and the cap member forms a similar curved shape in transverse cross section that is substantially coextensive with a perimeter of the shank.

24. The closure of claim 1 wherein the shank forms a circular shape in transverse cross section and the cap member forms an overall circular shape in transverse cross section that is substantially coextensive with a perimeter of the shank.

25. The closure of claim 1 wherein the cap portion has a perimeter that is substantially coextensive with a perimeter of the shank.

26. The closure of claim 1 wherein a top portion of the spout is disposed higher than the first hinge and the second hinge while in the closed position.

27. The closure of claim 1 wherein the cap portion includes a substantially conical frustum portion that extends upwardly while in the closed position.

* * * * *